US005220638A

United States Patent [19]

Moore et al.

[11] Patent Number: 5,220,638

[45] Date of Patent: Jun. 15, 1993

[54] WATER HEATER WITH AN IMPROVED THERMOSTAT MOUNTING AND A METHOD OF MAKING SUCH WATER HEATERS

[75] Inventors: Henry J. Moore, Playa Del Rey; Myron E. Deneau, Santa Monica, both of Calif.

[73] Assignee: Mor-Flo Industries, Inc., Cleveland, Ohio

[21] Appl. No.: 767,413

[22] Filed: Sep. 30, 1991

[51] Int. Cl.[5] ..... F24H 1/20

[52] U.S. Cl. ..... 392/449; 392/451; 392/498; 392/501

[58] Field of Search ..... 392/449, 451, 459, 498, 392/501, 450, 452–460; 122/19; 220/4.13, 459, 454, 449, DIG. 14; 126/361, 351; 219/441, 442

[56] References Cited

U.S. PATENT DOCUMENTS

| | | | |
|---|---|---|---|
| 2,226,526 | 12/1940 | Osterheld | 392/459 |
| 2,686,031 | 8/1954 | Bolesky | 248/205 |
| 2,718,583 | 9/1955 | Noland | 126/361 |
| 2,801,320 | 7/1957 | Prindle . | |
| 3,276,599 | 10/1966 | Them | 211/26 |
| 3,854,454 | 12/1974 | Lazaridis | 126/361 |
| 3,870,858 | 3/1975 | Schimke | 219/441 |
| 3,940,591 | 2/1976 | Ting | 392/459 |
| 3,992,608 | 11/1976 | Snavely . | |
| 4,234,783 | 11/1980 | Aoshima | 219/441 |
| 4,399,971 | 8/1983 | Fehrmann et al. | 248/221.3 |
| 4,657,215 | 4/1987 | Murphy | 248/221.3 |

*Primary Examiner*—Teresa J. Walberg

*Attorney, Agent, or Firm*—Body, Vickers & Daniels

[57] ABSTRACT

A water heater having a non-metallic tank and a surface mounted thermostat is provided with a thermostat mounting which reliably sensing water temperature. The thermostat mounting includes a large area plate in contact with the tank over a large area and fixed to the tank reinforcing fiberglass rovings.

23 Claims, 2 Drawing Sheets

WATER HEATER WITH AN IMPROVED THERMOSTAT MOUNTING AND A METHOD OF MAKING SUCH WATER HEATERS

The present invention pertains to the art of water heaters and more particularly to a construction for an electric water heater having a plastic tank and an external thermostat.

BACKGROUND OF THE INVENTION

Electric water heaters have been able for many years and generally comprise a tank containing a body of water, an electric heating element disposed within the tank to heat the water, a water inlet, a water outlet and a thermostat to control the application of electrical current to the heating element. Generally, the tank has been metallic and the thermostat has been held against this tank by means of a mounting bracket. One such arrangement is described in U.S. Pat. No. 4,657,215 to Murphy. Murphy describes a bracket which mounts upon a fitting welded to the water containing tank and urges the thermostat into intimate contact with the water containing tank. In this way, the thermostat senses the temperature of the water through the tank wall. Because the tank wall is metallic, it is a good conductor of heat. The tank wall is also generally thin so the sensor adequately monitors the water temperature.

Attempts have been made to manufacture electric water heaters using plastic tanks. Problems have been encountered. One problem is sensing of water temperature by a thermostat. One can put a fitting in the side of a plastic tank in a manner similar to a metal tank and apply a surface thermostat to the plastic tank as illustrated in Murphy U.S. Pat. No. 4,657,215. However, temperature sensing is not adequate. Moreover, such an approach requires a breach in the integrity of the side wall of the plastic tank which compromises its strength.

The present invention contemplates a new and improved water heater structure using a plastic tank which overcomes the above-referred to problems and others, and provides a water heater in which a thermostat reliably and accurately senses water temperature while maintaining tank integrity.

SUMMARY OF THE INVENTION

In accordance with the present invention, there is provided a water heater with a plastic tank having openings in its top and bottom only and having a metallic thermostat mounting plate of large area held tightly against the water heater tank side wall.

Still further in accordance with the invention, a water heater is provided with a thermostat mounting plate having a thermostat retention means which releasably and tightly holds a thermostat in intimate contact with a thermostat mounting plate such that the thermostat may be easily replaced or inspected for service.

Still further in accordance with the invention, the thermostat mounting plate is permanently fixed to the tank and generally isolated from the outside atmosphere such that temperature influences other than the water contained within the tank upon the plate are minimized.

Still further in accordance with the invention, the thermostat mounting plate is permanently applied to the plastic tank by means of fiberglass fibers wrapped around the plate in the tank whereby the mounting means also serves to strengthen and reinforce the tank structure.

The principle object of the present invention is the provision of a water heater using a plastic tank in which water temperature is reliably sensed by a surface application thermostat.

It is a further object of the present invention to provide a thermostat mounting means not requiring a breach of the integrity of the water heater tank structure.

It is yet a further object of the present invention to provide a thermostat mounting means which provides a large surface area and intimate contact with the water heater water containing tank for sensing water temperature which is permanently fixed to the water containing tank.

It is a further object of the present invention to provide a thermostat mounting means which allows the easy inspection and removal of the thermostat for service or replacement.

Further objects and advantages of the invention will become apparent from the following detailed description of the preferred embodiment of the invention and from the accompanying drawings.

BRIEF DESCRIPTION OF THE DRAWINGS

The invention may take physical form in certain parts and arrangements of parts, a preferred embodiment of which will be described in detail and illustrated in the accompanying drawings which form a part hereof and wherein.

DESCRIPTION OF THE PREFERRED EMBODIMENT

Figure 1:
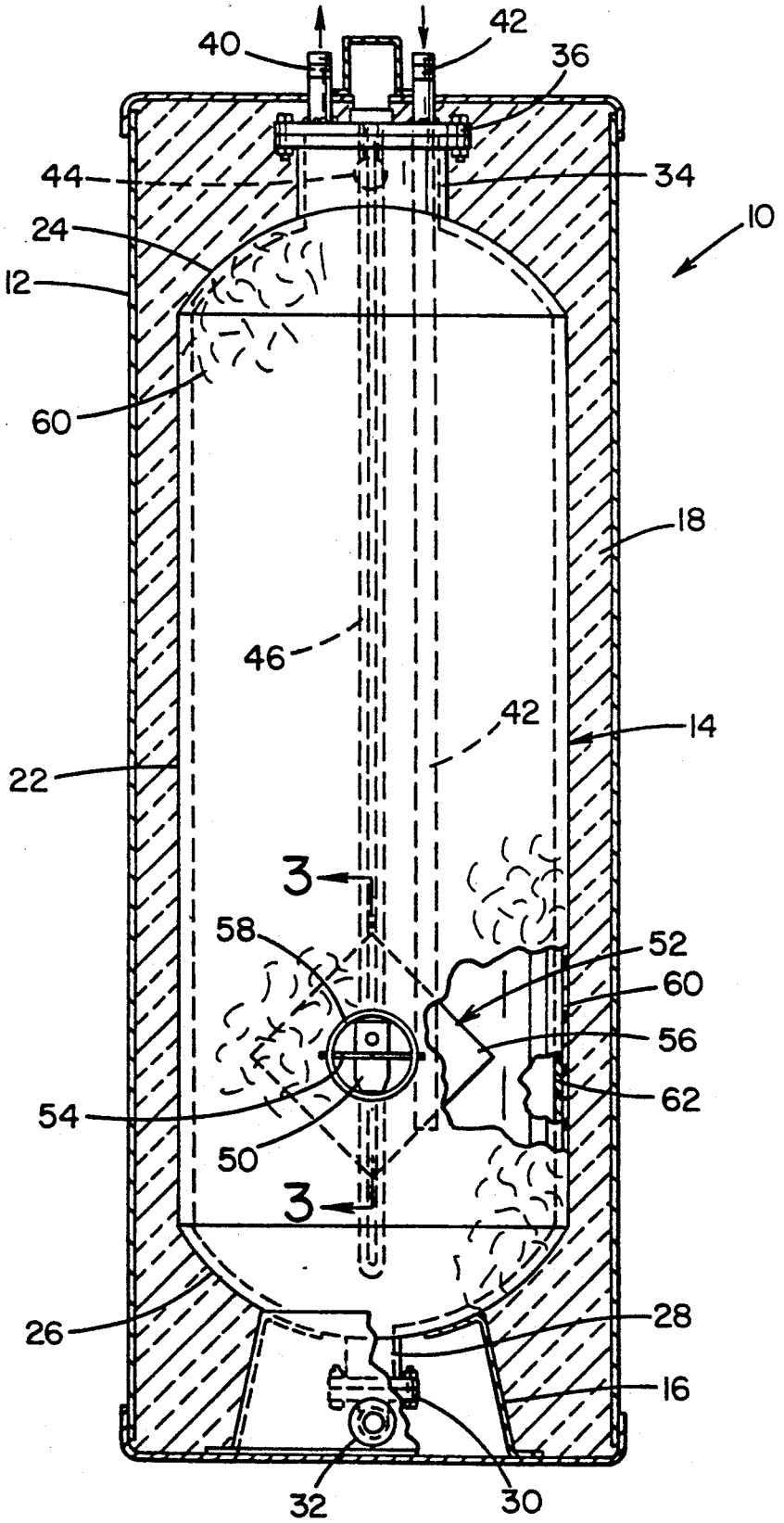
FIG. 1 is an elevation of an electric water heater in accordance with the present invention with the covering insulation and outer jacket removed and interior structure shown in dashed lines.

Referring now to the drawings wherein the showings are for purposes of illustrating a preferred embodiment of the invention only and not for purposes of limiting same, the figures show an electric water heater 10. An outer jacket 12 shown in FIG. 2 and in cross section in FIG. 1 surrounds a water containing plastic tank 14 which is supported on a base 16 within the jacket 12. The volume between the plastic tank 14 and the jacket 12 is filled with a body of insulation 18.

The plastic tank 14 has a generally cylindrical center section 22, a convex top 24 and a convex bottom 26. A bottom extension 28 is generally cylindrical and coaxial with the cylindrical center section 22 and extends downwardly from the very bottom of the water heater tank. The bottom extension 28 is closed by a bottom plate 30 which is bolted to a flange around the bottom extension 28. A drain valve 32 is mounted on the bottom plate 30.

The drain valve 32 extends through the jacket 12 and allows one to drain away sediments from the bottom of the water heater. A cylindrical top extension 34 is generally coaxial with the cylindrical center section 22 and extends from the convex top 24. The top extension 34 is closed at its top by a top plate 36. The top plate 36 is preferably a disk of stainless steel which is bolted to a flange on the top extension 34. The top plate 36 is provided with threaded holes into which are mounted a temperature and pressure relief valve 38, a hot water outlet 40, a cold water inlet tube 42, a float switch 44 and a heating element 46. The temperature and pressure relief valve is conventional. The hot water outlet tube is also conventional and is simply a short length of pipe extending upwardly from the top plate 36. The cold water inlet tube is conventional and comprises what is generally known as a dip tube extending downwardly into the plastic tank 14 and a short length of pipe extending upwardly from the top plate 36. The float switch is also conventional and comprises a commercially available float switch which reacts to the presence or absence of water at the top of the tank and is used to prevent electric current from flowing through the heating element when the tank is not full. The heating element is also conventional and comprises an electrical resistance heating element for submersion in water extending downwardly in the tank from the top plate 36.

Figure 2:
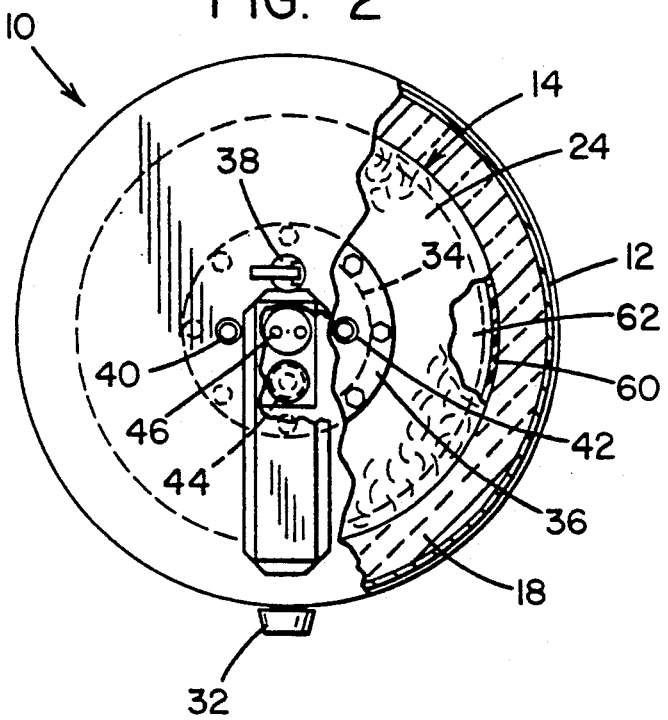
FIG. 2 is a top view of the same water heater seen in FIG. 1.
Figure 3:
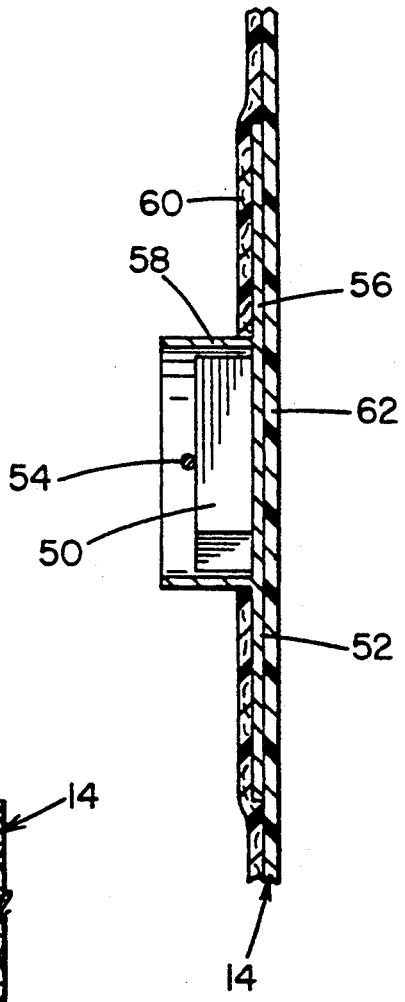
FIG. 3 is an enlarged cross section of the water heater in FIGS. 1 and 2 taken along the lines 3—3 of FIG. 1.
Figure 4:
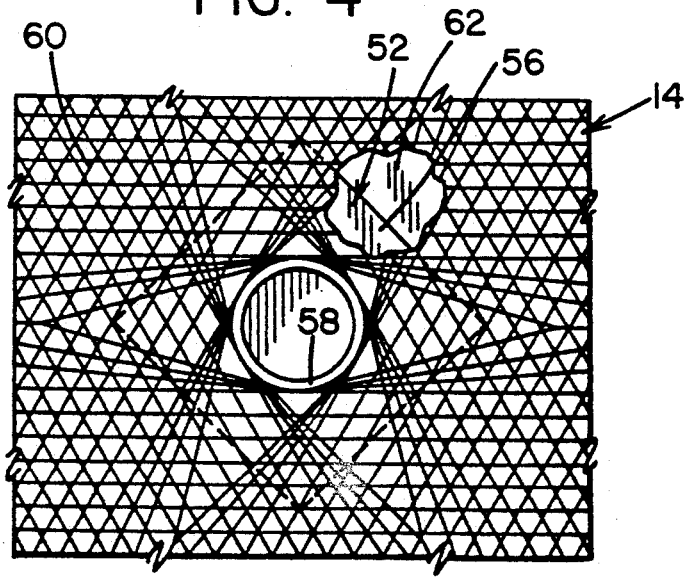
FIG. 4 is a detailed view showing the thermostat mounting plate retained on the tank by fiberglass rovings.

Current to the heating element 46 is controlled by a thermostat 50. The thermostat 50 and its mounting arrangement are seen in FIGS. 1, 3 and 4. The thermostat 50 is held tightly against a thermostat mounting plate 52 by a thermostat retention pin 54. The thermostat 50 is conventional in design and commercially available. Such thermostats typically have metallic backs about 1.5 inches (38 mm) wide and 3.25–4.25 inches (83 mm–108 mm) high. It senses temperature on the surface pressed against the thermostat mounting plate 52, passes electrical current to the heating element 46 when the temperature sensed falls below a certain value and interrupts current to the heating element 46 when the temperature sensed rises above a certain value. In order for the thermostat 50 to correctly control the heating element 46, it must reliably sense the temperature of the water contained within the tank. This is accomplished in the present invention by assuring that the temperature of the thermostat mounting plate 52 follows the temperature of the water. As can be seen in FIGS. 1 and 4, the thermostat mounting plate 52 comprises a rectangular, metallic sheet of large surface area. The sheet 56 is curved to correspond to the contour of the cylindrical center section 22 of the tank 14. The rectangular sheet has a large surface area which is pressed against the tank 14 and senses the temperature of the tank over a large area. In the preferred embodiment, the plate is a square 8 inches by 8 inches. Other shapes could be used. In the center of the rectangular sheet 56 is a cylindrical retainer wall 58. The axis of the cylindrical retainer wall 58 is generally perpendicular to the axis of the water heater. The cylindrical retainer wall 58 is provided with two small holes on opposite sides of the diameter into which the thermostat retention pin 54 is mounted for engagement against the thermostat 50.

The plastic tank 14 is a hollow, generally cylindrically shaped body. It is comprised of a high density polyethylene inner shell portion 62 which is coated with a layer of fiberglass rovings and epoxy resin 60. The tank can be formed by rotational molding or the like. The tank is reinforced and strengthened by wrapping or winding fiberglass filaments impregnated in epoxy 60 around the tank. In the present invention, the thermostat mounting plate is applied to the polyethylene inner shell 62 prior to winding and coating with fiberglass and epoxy 60. The fiberglass windings 60 overlay the mounting plate 52 and tightly hold it against the polyethylene inner portion 62 of the tank 14. As can be seen best in FIG. 3, the large area mounting plate 52 is intimately in contact with the polyethylene inner shell portion 62 and held tightly in place by the fiberglass epoxy layer 60. The cylindrical retaining wall 58 prevents the fiberglass winding from covering the central portion of the thermostate mounting plate 52 thereby preserving a clear area for application of the thermostat so. In operation, the rectangular sheet 56 senses the temperature of the body of water contained within the tank 14. Because of the large size of the rectangular sheet and its intimate contact against the tank inner portion 62, the thermostat mounting plate 52 closely follows the temperature of the water within the tank 14. The rectangular sheet is insulated against other temperature influences by the resin and fiberglass layer 60 and the body of insulation which fills the volume between the tank 14 and the outer jacket 12. The sensor in the thermostat 50 is held in intimate contact against the rectangular sheet 56 by means of a thermostat retention pin 54. It senses the temperature of the rectangular sheet 56 and controls the operation of the heating elements 46 in response thereto. Reliable water heater operation is thereby provided. Moreover, a mounting structure which allows the easy replacement of the thermostat is also provided. The invention has been described with reference to a preferred embodiment. Obviously, modifications and alterations will occur to others upon the reading and understanding of this specification. It is our intention to include all such modifications and alterations insofar as they come within the scope of the appended claims or the equivalence thereof.

Having thus described the invention, it is claimed:

1. An improvement in an electric water heater comprising:

a non-metallic tank, a cold water inlet, a hot water outlet, an electrical heating means adapted to heat a body of water contained in said tank and a thermostat having a sensing face with a given area controlling the flow of electric current to said heating means; the improvement comprising a thermally conductive thermostat mounting plate having a surface area substantially larger than said sensing face given area in direct contact with said tank and a thermostat retention means releasably holding said thermostat in contact with said thermostat mounting plate.

2. The improvement of claim 1 wherein said tank is generally cylindrical having a curved side wall and said thermostat mounting plate is curved to match the contour of said sidewall.

3. The improvement of claim 1 wherein said thermostat has a sensing face having a given area and said thermostat mounting plate has an area several times as large as said thermostat sensing face given area.

4. The improvement of claim 1 wherein said thermostat has a sensing face having a given area and said thermostat mounting plate has an area approximately ten times as large as said thermostat sensing face given area.

5. The improvement of claim 1 wherein said thermostat mounting plate is metallic.

6. An improvement in an electric water heater comprising:

a non-metallic tank, a cold water inlet, a hot water outlet, an electrical heating means adapted to heat a body of water contained in said tank and a thermostat controlling the flow of electric current to said heating means; the improvement comprising a thermally conductive thermostat mounting plate having a large surface area in contact with said tank and a thermostat retention means holding said thermostat in contact with said thermostat mounting plate;

said thermostat mounting plate being held against said tank by fibers wrapped around said tank.

7. An improvement in an electric water heater comprising:

a non-metallic tank, a cold water inlet, a hot water outlet, an electrical heating means adapted to heat a body of water contained in said tank and a thermostat controlling the flow of electric current to said heating means; the improvement comprising a thermally conductive thermostat mounting plate having a large surface area in contact with said tank and a thermostat retention means holding said thermostat in contact with said thermostat mounting plate; said tank comprising an inner shell and non-metallic fiber rovings embedded in a resin matrix surrounding said inner shell, said thermostat mounting plate being held against said shell by said rovings.

8. The improvement of claim 7 wherein said tank has a side wall and said thermostat retention means comprises a retainer wall substantially perpendicular to said tank side-wall surrounding a thermostat mounting area, said thermostat mounting area being substantially free of rovings.

9. The improvement of claim 8 wherein said thermostat mounting means additionally comprises a plurality of holes in said retainer wall and at least one pin engaging said thermostat and at least one of said holes.

10. The improvement of claim 8 wherein said retainer wall is cylindrical.

11. An improvement in a water heater comprising:

a non-metallic tank, a cold water inlet, a hot water outlet, a heating means adapted to heat a body of water contained within said tank and a thermostat having a sensing face with a given area controlling said heating means; the improvement comprising a thermostat mounting plate having a surface area substantially larger than said sensing face given area in direct contact with said tank and a thermostat retention means adapted to releasably hold said thermostat in contact with said thermostat mounting plate.

12. The improvement of claim 11 wherein said tank is generally cylindrical having a curved side wall an said thermostat mounting plate is curved to match the contour of said side wall.

13. The improvement of claim 11 wherein said thermostat has a sensing face having a given area and said thermostat mounting plate has an area several times as large as said thermostat sensing face given area.

14. The improvement of claim 13 wherein said mounting plate has an area approximately ten times as large as said thermostat sensing face given area.

15. An improvement in a water heater comprising:

a non-metallic tank, a cold water inlet, a hot water outlet, a heating means adapted to heat a body of water contained within said tank and a thermostat controlling said heating means; the improvement comprising a thermostat mounting plat having a large surface area in contact with said tank and a thermostat retention means adapted to hold said thermostat in contact with said thermostat mounting plate; said thermostat mounting plate being held against said tank by fibers wrapped around said tank.

16. An improvement in a water heater comprising:

a non-metallic tank, a cold water inlet, a hot water outlet, a heating means adapted to heat a body of water contained within said tank and a thermostat controlling said heating means; the improvement comprising a thermostat mounting plat having a large surface area in contact with said tank and a thermostat retention means adapted to hold said thermostat in contact with said thermostat mounting plate; said tank comprising an inner shell and non-metallic fiber rovings embedded in a resin matrix surrounding said inner shell, said thermostat mounting plate being held against said shell by said rovings.

17. The improvement of claim 16 wherein said rovings are fiberglass.

18. The improvement of claim 16 wherein said tank has a side wall and said thermostat retention means comprises a retainer wall substantially perpendicular to said tank side wall surrounding a thermostat mounting area, said thermostat mounting area being substantially free of rovings.

19. The improvement of claim 18 wherein said retainer wall is cylindrical.

20. The improvement of claim 16 wherein said thermostat mounting means additionally comprises a plurality of holes in said retainer wall and at least one pin engaging said thermostat and at least one of said holes.

21. A method of making a water heater comprising:

providing a generally cylindrical, non-metallic inner shell having a cylindrical side wall;

providing a thermally conductive thermostat mounting plate having a large surface area adapted to lay against said side wall;

applying said thermostat mounting plate to said inner shell side wall;

applying a layer of non-metallic fibers in a resin matrix to said inner shell area and a major portion of said thermostat mounting plate;

allowing said fiberglass and resin layer to cure; and, providing a cold water inlet, a hot water outlet, and a heating means in said shell and providing a thermostat and body of insulation outside of said shell.

22. The method of claim 21 wherein said non-metallic fibers in a resin matrix is applied over substantially all of said inner shell cylindrical side wall.

23. The method of claim 22 wherein said thermostat mounting plate is provided with a retainer wall substantially perpendicular to said shell side wall, said retainer wall surrounding a thermostat mounting area, said thermostat mounting area being kept free of said layer of non-metallic fibers in a resin matrix.

* * * * *